United States Patent [19]

Sugawara et al.

[11] Patent Number: 4,506,160

[45] Date of Patent: Mar. 19, 1985

[54] ION SOURCE APPARATUS

[75] Inventors: Toru Sugawara, Fujisawa; Yasuyuki Ito, Yokohama, both of Japan

[73] Assignee: Tokyo Shibaura Denki Kabushiki Kaisha, Kawasaki, Japan

[21] Appl. No.: 495,536

[22] Filed: May 17, 1983

[30] Foreign Application Priority Data

May 24, 1982 [JP] Japan ..... 57-86562
Jun. 8, 1982 [JP] Japan ..... 57-96942

[51] Int. Cl.[3] ..... H01J 27/00

[52] U.S. Cl. ..... 250/427; 250/423 R; 376/127; 376/130

[58] Field of Search ..... 250/423, 427; 313/338, 313/339; 376/127, 130

[56] References Cited

U.S. PATENT DOCUMENTS 3,453,480 7/1969 Katz ..... 313/337

OTHER PUBLICATIONS

Nuclear Instruments and Methods, vol. 127, No. 2 (Aug. 1975), R. Kirchner et al., "A Cathode With Long Lifetime for Operation of Ion Sources With Chemically Aggressive Vapours," pp. 307–309.

Review of Scientific Instruments, vol. 48, No. 11 (Nov. 1977), V. Laul et al., "Improved Method for Heating Large Tungsten Cathodes," pp. 1499–1500.

Review of Scientific Instruments, vol. 40, No. 12 (Dec. 1969), N. Rynn, "A Method for Uniformly Heating a Metallic Surface in a Vacuum," pp. 1650–1651.

Proceedings of the 7th Symposium on Engineering Problems of Fusion Research (Oct. 25–28, 1977), J. H. Fink et al., "A Long-Life Cathode for the Berkeley-Type Ion source," pp. 1398–1399.

N. Rynn, Rev. Sci. Instrum. 35 (40) 1650–1 (1964).

V. Laul, N. Rynn, H. Böhmer, Rev. Sci. Instrum. 48 (11) 1499 (1977).

M. M. Menon et al., 12th Symposium of Fusion Technology, Jülich (1982), and D. E. Schechter, C. C. Tsai, 9th Symposium of Engineering Problems of Fusion Research, Chicago.

9th Symposium on Engineering Problems of Fusion Research Chicago, 1981 D. E. Schecter and C. C. Tsai.

*Primary Examiner*—Bruce C. Anderson
*Assistant Examiner*—Paul A. Guss
*Attorney, Agent, or Firm*—Oblon, Fisher, Spivak, McClelland & Maier

[57] ABSTRACT

A gas is introduced into a discharge chamber of an ion source apparatus, and a gas discharge is performed between a thermionic cathode and an anode. Ions are extracted from the plasma formed in this gas discharge by a grid electrode. The thermionic cathode has a hollow cylindrical shape. A cathode chamber is defined by the thermionic cathode and a cylindrical partition wall supporting it. A columnar auxiliary electrode is coaxially inserted in the thermionic cathode. An A.C. voltage from a power source unit is supplied between the thermionic cathode and the auxiliary electrode such that effective power for keeping the thermionic cathode at a positive potential with respect to the auxiliary electrode is higher than that for keeping the auxiliary electrode at a positive potential with respect to the thermionic cathode.

13 Claims, 7 Drawing Figures

ION SOURCE APPARATUS

BACKGROUND OF THE INVENTION

The present invention relates to an ion source apparatus for heating a thermionic cathode by discharge and/or electron bombardment to produce thermoelectrons, ionizing gas molecules by the thermoelectrons, and extracting ions.

In an ion source apparatus supplied to an apparatus, such as an NBI (neutral beam injector), a plasma is produced by gaseous discharge, and ions are extracted from the plasma and accelerated into a high-speed ion beam by an electric field. In a prior art of ion source apparatus using a plurality of linear heating elements or wires as a thermionic cathode, the heating wires may be conducted to emit thermoelectrons, and a gas in a discharge chamber ionized by the thermoelectrons. However, since the thermionic cathode is subjected to evaporation or sputtering, the service life of the thermionic cathode is short. This requires frequent replacement of the thermionic cathode consisting of a plurality of wires, which results in inconvenient and costly operation of the NBI.

In an ion source apparatus using a plate-shaped thermionic cathode, an auxiliary electrode is incorporated to oppose the thermionic cathode. An AC voltage is supplied between the thermionic cathode and the auxiliary electrode so as to produce electron emission current. In such an apparatus, while the thermionic cathode is heated by electron bombardment or discharge, the auxiliary electrode must also be heated. Therefore, when a plasma for extracting ions is to be maintained, power is also consumed for heating the auxiliary electrode.

SUMMARY OF THE INVENTION

It is an object of the present invention to provide an ion source apparatus of the type wherein a thermionic cathode is heated by electron bombardment or discharge, which is capable of effectively heating the thermionic cathode.

It is another object of the present invention to provide an ion source apparatus which allows effective utilization of heat radiated by a thermionic cathode for heating an auxiliary electrode.

It is another object of the present invention to provide an ion source apparatus which reduces power consumption to the minimum.

It is still another object of the present invention to provide an ion source apparatus which is capable of prolonging the service life of a thermionic cathode.

In order to achieve the above objects, the present invention provides an ion source apparatus having a discharge chamber and a cathode chamber. A thermionic cathode defines the discharge and cathode chambers at its two sides. An auxiliary electrode is arranged in the cathode chamber so that emission current and/or electron current is produced between the thermionic cathode and the auxiliary electrode. A power source unit supplies a voltage between the thermionic cathode and the auxiliary electrode to cause an electric current flow therebetween. The power source unit supplies an A.C. voltage between the thermionic cathode and the auxiliary electrode so that the effective power required to maintain the thermionic cathode at a positive potential with respect to the auxiliary electrode is higher than that required to maintain the auxiliary electrode at a positive potential with respect to the thermionic cathode. A gas is supplied to the discharge chamber. Discharge occurs between an anode and the thermionic cathode which is heated by discharge and/or electron bombardment between the thermionic cathode and the auxiliary electrode in the discharge chamber, thereby ionizing the gas.

The thermionic cathode and the auxiliary electrode may be formed into flat plate-like shapes, and they may be opposed to each other at a predetermined distance. Since the effective power required to maintain the thermionic cathode at a positive potential is higher than that required to maintain the auxiliary electrode at a positive potential, the number and energy of the electrons bombarding the thermionic cathode are greater than those bombarding the auxiliary electrode in the heating process of the thermionic cathode and the auxiliary electrode. Therefore, the thermionic cathode may be heated more than to the auxiliary electrode. When the power distribution ratio is adjusted, the heating degree of the thermionic cathode and the auxiliary electrode may be altered. For this reason, a minimum power is needed to maintain the auxiliary electrode at a temperature high enough to supply thermoelectrons to the thermionic cathode to heat it. Thus, extra power for maintaining emission current or electron current between the thermionic cathode and the auxiliary electrode for heating the thermionic cathode may be saved.

At least part of the thermionic cathode may surround part of the auxiliary electrode at a suitable distance. Then, the heat of thermionic cathode generated by electron bombardment or discharge may be effectively radiated on the auxiliary electrode. Then, heat radiated by the thermionic cathode may be effectively utilized for heating the auxiliary electrode. Power for holding the temperature of the thermionic cathode and auxiliary electrode may thus be further saved. In addition to this effect, when the part of the thermionic cathode surrounds part of the auxiliary electrode, the thermal load of the radiated heat from the auxiliary electrode on other members is reduced to the minimum. With such a structure, the volume of the auxiliary electrode may be made smaller than that of the thermionic cathode. Therefore, the heat capacity of the auxiliary electrode may be small, and the auxiliary electrode can be heated quickly with less power.

DETAILED DESCRIPTION OF THE PREFERRED EMBODIMENTS

Figure 1:
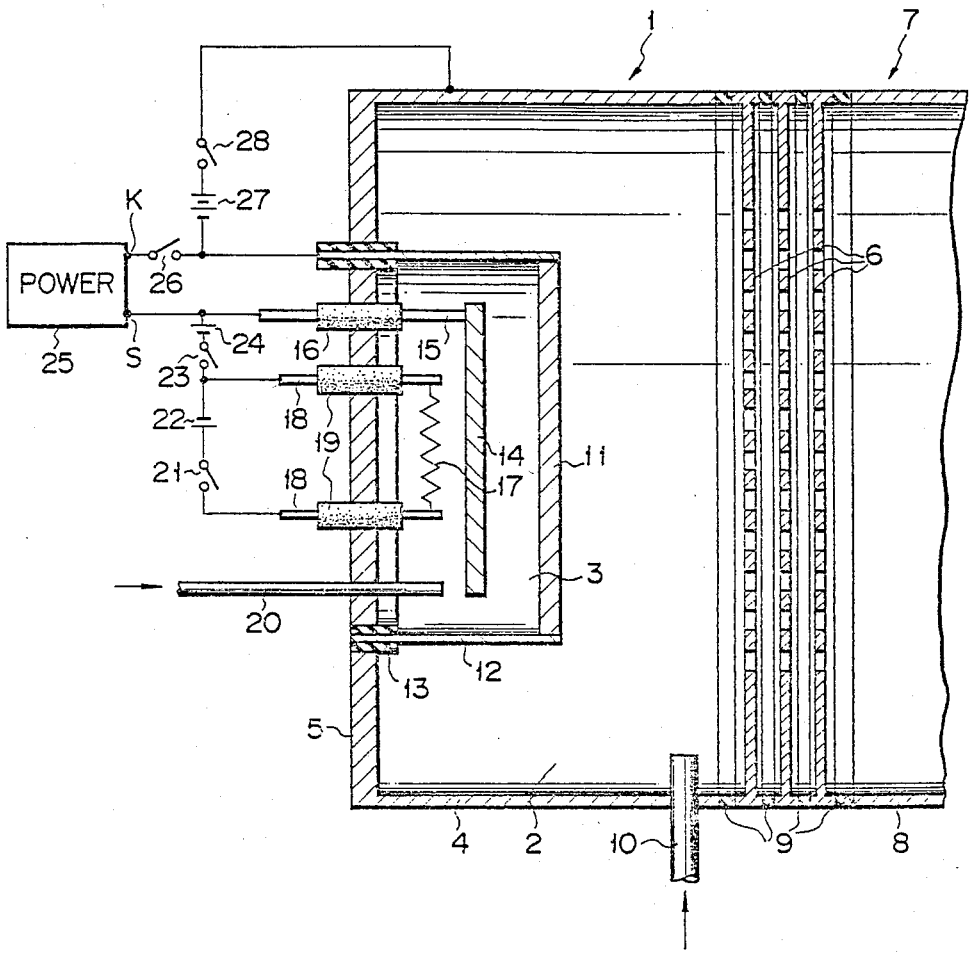
FIG. 1 is a sectional view showing an ion source apparatus according to an embodiment of the present invention.

FIG. 1 shows an ion source apparatus according to an embodiment of the present invention. An ion source 1 has a discharge chamber 2 and a cathode chamber 3. The discharge chamber 2 is defined by a cylindrical metal anode wall 4, a disc-shaped side wall 5, and grid electrodes 6. A neutralizing cell 7 is arranged next to the ion source 1 through the grid electrodes 6. The interior of a housing 8 of the neutralizing cell 7 communicates with that of the discharge chamber 2 of the ion source 1 through the grid electrodes 6. Insulators 9 are interposed between the adjacent pairs of grid electrodes 6, between the anode wall 4 and the leftmost grid electrode 6, and between the housing 8 and the rightmost grid electrode 6 to provide insulation. An inlet pipe 10 connected to a suitable gas supply source (not shown) extends through the anode wall 4 so as to supply the gas into the discharge chamber 2.

A cylindrical partition wall 12 is arranged at substantially the center of the side wall 5 such that its longitudinal axis is aligned with that of the anode wall 4. The partition wall 12 is mounted on the side wall 5 through a cylindrical insulator 13. A disc-shaped metal thermionic cathode 11 is mounted on the distal end of the partition wall 12. The cathode chamber 3 is defined by the thermionic cathode 11, the partition wall 12 and the side wall 5. A disc-shaped metal auxiliary electrode 14 of a diameter smaller than that of the thermionic cathode 11 is arranged in the cathode chamber 3 at a distance from the thermionic cathode 11 and parallel thereto. The auxiliary electrode 14 is mounted on the distal end of a support rod 15 which is mounted on the side wall 5 through an insulator 16. A heating wire 17 such as a tungsten filament is arranged between the auxiliary electrode 14 and the side wall 5 but closer to the auxiliary electrode 14. The ends of the heating wire 17 are mounted on the distal ends of a pair of support rods 18 which are in turn mounted on the side wall 5 through insulators 19. A pipe 20 extends through the side wall 5 into the cathode chamber 3. The pipe 20 is selectively connected to a suitable gas supply source (not shown) or a vacuum pump. The cathode chamber 3 is thus evacuated or is filled with a low pressure gas through the pipe 20.

The support rods 15 and 18 and the partition wall 12 comprise an electrically conductive material. Various power sources are arranged outside the discharge and cathode chambers 2 and 3. A power source 22 and a switch 21 are series-connected between the pair of support rods 18. When the switch 21 is turned on, the heating wire 17 is energized by the power from the power source 22 and is heated by its resistance. A power source 24 and a switch 23 are series-connected between the support rods 18 and 15. When the switch 23 is turned on, an electric field directed from the auxiliary electrode 14 toward the heating wire 17 is established therebetween. A power source unit 25 for causing an electric current flow and a switch 26 for electrically connecting the unit 25 and the partition wall 12 are series-connected between the thermionic cathode 11 and the auxiliary electrode 14. A power source 27 and a switch 28 are series-connected between the partition wall 12 and the anode wall 4. When the switch 28 is turned on, a voltage is applied between the thermionic cathode 11 and the anode wall 4, and a discharge is caused in the gas introduced in the discharge chamber 2 through the inlet pipe 10.

Figure 2:
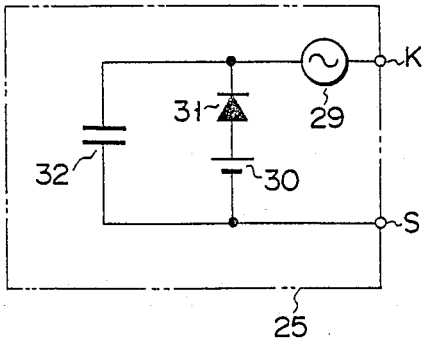
FIG. 2 is a circuit diagram of a power source unit for the apparatus shown in FIG. 1.
Figure 3:
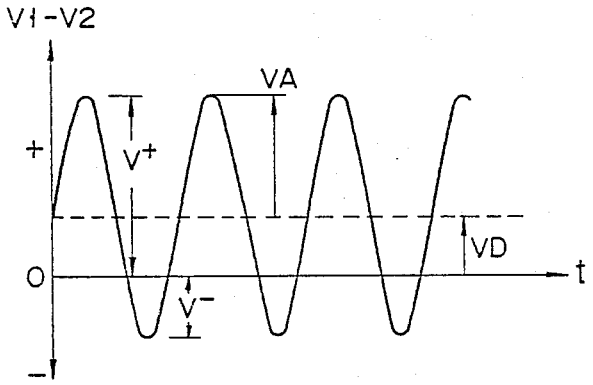
FIG. 3 shows the waveform of a signal supplied from the power source unit shown in FIG. 2.

The configuration of the main power source unit 25 will now be described with reference to FIG. 2. The main power source unit 25 has an AC power source 29 and a DC power source 30 between output terminals K and S which are respectively connected to the partition wall 12 and the support rod 15. The DC power source 30 is connected in series with a diode 31, and a capacitor 32 is connected in parallel with the diode 31 and the power source 30. The AC power source 29 is connected between the terminal K and this parallel circuit. When the capacitance of the capacitor 32 is represented by C, the output voltage from the DC power source 30 is represented by $V_D$, the voltage amplitude of the AC power source 29 is represented by $V_A$, the angular frequency of the AC power source 29 is $\omega$, and the discharge or emission current between the thermionic cathode 11 and the auxiliary electrode 14 is represented by I, C and the like are determined so as to satisfy the inequality $C>>I/(\omega V_D)$. Therefore, when the capacitor 32 discharges, the DC power source 30 immediately charges the capacitor 32 and a voltage $V_C$ across the capacitor 32 normally approximates $V_D$. Then, AC voltages which are DC biased are produced from the output terminals K and S. When the potentials at the thermionic cathode 11 and the auxiliary electrode 14 are respectively represented by $V_1$ and $V_2$, a potential $(V_1-V_2)$ obtained by superposition of an AC voltage of amplitude $V_A$ on the DC voltage $V_D$ is supplied between the thermionic cathode 11 and the auxiliary electrode 14, as shown in FIG. 3. A set of grid electrodes 6 plays an role of ion beam extraction. Ions are extracted from the plasma produced by discharge in the gas introduced into the discharge chamber 2 and are accelerated by the grid electrodes 6.

The mode of operation of the apparatus of the configuration as described above will now be described. First, the switches 21 and 23 are turned on. Then, the heating wire 17 is energized by the power source 22 to generate heat by its resistance. The thermoelectrons emitted from the heating wire 17 are accelerated toward the auxiliary electrode 14 by the electric field formed between the auxiliary electrode 14 and the heating wire 17 by the power source 24. The auxiliary electrode 14 is heated by electron bombardment. When the switch 26 is turned on, the voltage of the waveform shown in FIG. 3 is supplied between the thermionic cathode 11 and the auxiliary electrode 14. Then, thermoelectrons are emitted from the heated auxiliary electrode 14. The thermoelectrons are accelerated by the electric field [potential difference $(V_1-V_2)$] formed between the thermionic cathode 11 and the auxiliary electrode 14 and are bombarded upon the surface of the thermionic cathode 11 opposing the auxiliary electrode 14. Upon this bombardment, the thermionic cathode 11 is heated. Thermoelectrons are emitted from the heated thermionic cathode 11, and the thermionic cathode 11 and the auxiliary electrode 14 bombard each other with electrons based on the potential difference $(V_1-V_2)$ shown in FIG. 3 and are heated thereby. When the thermionic cathode 11 and the auxiliary electrode 14 are heated by electron bombardment or discharge, the switches 21 and 23 are both turned off to stop energizing the heating wire 17 and heating the auxiliary electrode 14 by electrons from the heating wire 17. When the thermionic cathode 11 is heated to a predetermined temperature, thereafter, the power source unit 25 supplies power to it and to the auxiliary electrode 14, which is sufficient to compensate for the heat loss which may be caused by heat radiation and conduction at the thermionic cathode 11 and the auxiliary electrode 14. Electric current flow between the thermionic cathode 11 and the auxiliary electrode 14 is maintained, and the thermionic cathode 11 and the auxiliary electrode 14 are heated to predetermined temperatures upon being mutually bombarded with each other's thermoelectrons. Electric current flow in the cathode chamber 3 may be caused in a vacuum upon evacuating the cathode chamber 3 through the pipe 20 or in a low-pressure gas introduced into the cathode chamber 3 through the pipe 20.

The voltage ($V_1$-$V_2$) as shown in FIG. 3 is supplied between the thermionic cathode 11 and the auxiliary electrode 14. The power of the electrons which bombard the thermionic cathode 11 is proportional to $(V^+)^{5/2}[=(V_A+V_D)^{5/2}]$, while the power of the electrons which bombard the auxiliary electrode 14 is proportional to $(V^-)^{5/2}[=(V_A-V_D)^{5/2}]$ in a space-charge limited region. In other words, the number of electrons emitted from the auxiliary electrode 14 and the energy of the electrons accelerated toward the thermionic cathode 11 depend on $V^+$, and the number of electrons emitted from the thermionic cathode 11 and the energy of the electrons accelerated toward the auxiliary electrode 14 depend on $V^-$. Therefore, the thermionic cathode 11 is heated to a higher temperature than that of the auxiliary electrode 14 by the emission current or the electron current. Then, by suitably setting the DC voltage $V_D$, the auxiliary electrode 14 may be heated to a lower temperature which is sufficient to maintain electric current flow between itself and the thermionic cathode 11, while the thermionic cathode 11 is heated to a higher temperature for causing gas discharge in the discharge chamber 2. Accordingly, extra power for heating the auxiliary electrode 14 is not required, which results in a saving of power.

A gas for generating ions is supplied to the discharge chamber 2 through the inlet pipe 10. The switch 28 is turned on, and a voltage from the power source 27 is supplied between the thermionic cathode 11 and the anode wall 4. Then, gas discharge between the thermionic cathode 11 and the anode wall 4 is caused in the discharge chamber 2 to produce a plasma. $H^+$ or $H_2^+$ ions are extracted from the plasma by the grid electrodes 6. These ions are accelerated by the grid electrodes 6 and are supplied to the neutralizing cell 7.

A modification of the power source unit 25 will now be described with reference to FIG. 4. The discharge power source unit 25 comprises an AC power source 34, a diode 35 connected in series with the AC power source 34, a thyristor 36 connected in parallel with and opposite to the diode 35, and a phase adjuster 37 for controlling the thyristor 36. When the voltage from the AC power source 34 has a waveform as shown in FIG. 5(*a*), a current flowing between the terminal K connected to the thermionic cathode 11 and the terminal S connected to the auxiliary electrode 14 by supplying power between the thermionic cathode 11 and the auxiliary electrode 14 becomes as shown in FIG. 5(*b*). Thus, an AC current with a part of its negative component being cut off for phase difference $\alpha$ set by the phase adjuster 37 flows between the terminals K and S. The effective power of the electrons bombarded upon the thermionic cathode 11 is higher than that of the electrons bombarded upon the auxiliary electrode 14. As in the case of the power sources shown in FIGS. 2 and 3, no extra power need be supplied to the auxiliary electrode 14 in order to effectively heat the thermionic cathode 11 in the power sources shown in FIGS. 4 and 5. The ratio of heating power for the thermionic cathode 11 and the auxiliary electrode 14 may be easily adjusted by changing the voltage $V_D$ of the DC power source 30 in the power source unit 25 shown in FIG. 2 and by changing the phase difference $\alpha$ of the phase adjuster 37 in the power source unit 25 shown in FIG. 4. The heating power ratio may be suitably adjusted in accordance with the thermoelectron emission area and the heat loss of the thermionic cathode 11 and the auxiliary electrode 14.

Another embodiment of the present invention will now be described with reference to FIG. 6. The same reference numerals in FIG. 6 denote the same parts in FIG. 1, and a detailed description thereof will be omitted. A thermionic cathode 11*a* has a cylindrical shape with a closed distal end. A cylindrical partition wall 12*a* is mounted at substantially the center of a side wall 5 through an insulator 13. The proximal end of the thermionic cathode 11*a* is sealed to the front end of the partition wall 12*a*. A cathode chamber 3 is defined by the thermionic cathode 11*a*, the partition wall 12*a* and the side wall 5. A columnar or cylindrical auxiliary electrode 14*a* is disposed inside the cathode chamber 3. The auxiliary electrode 14*a* is mounted to the side wall 5 through a support rod 15*a* so as to be coaxial with the thermionic cathode 11*a*. The support rod 15*a* is insulated from the side wall 5 by an insulator 16. The outer circumferential surface and the distal end face of the auxiliary electrode 14*a* are separated from the inner circumferential surface and the inner side end face of the thermionic cathode 11*a*, respectively, at predetermined distances. Electric current flow is caused in the space thus defined between the auxiliary electrode 14*a* and the thermionic cathode 11*a*. A heating wire 17 is arranged to oppose the proximal end face of the auxiliary electrode 14*a*.

In the apparatus of this embodiment, thermoelectrons emitted from the heating wire 17 are bombarded upon the auxiliary electrode 14*a* to heat it. When a voltage as shown in FIG. 3 or 5 is supplied from a power source unit 25 between the thermionic cathode 11*a* and the auxiliary electrode 14*a* after the auxiliary electrode 14*a* is heated to a predetermined temperature, electric current flow is caused therebetween. In this case, the interior of the auxiliary cathode chamber 3 may be evacuated or filled with a low-pressure gas through a pipe 20. The thermionic cathode 11*a* and the auxiliary electrode 14*a* are heated by electron bombardment and/or discharge. When this heating process is maintained in a stable manner, power supply to the heating wire 17 is stopped. After the thermionic cathode 11*a* is heated to a predetermined temperature, the power necessary to compensate for the heat loss due to heat radiation and heat conduction is supplied between the thermionic cathode 11*a* and the auxiliary electrode 14*a*, so that the thermionic cathode 11*a* is maintained at the predetermined temperature. Electric current flow between the thermionic cathode 11*a* and the auxiliary electrode 14*a* is maintained, and the gas introduced into the discharge chamber 2 through an inlet pipe 10 is ionized by discharge.

In this embodiment, since the auxiliary electrode 14*a* is surrounded by the thermionic cathode 11*a*, radiated heat from the heated thermionic cathode 11*a* is utilized for heating the auxiliary electrode 14*a*. For this reason, power to be supplied for maintaining the temperatures of the thermionic cathode 11*a* and the auxiliary electrode 14*a* is reduced to the minimum. In addition, the heat load on members in the discharge chamber 2 except for the thermionic cathode 11*a* and the auxiliary electrode 14*a* is reduced to the minimum. Since the thermionic cathode 11*a* surrounds the auxiliary electrode 14*a*, the thermal capacity (volume) of the auxiliary electrode 14*a* is smaller than that of the thermionic cathode 11*a*. Thus, the auxiliary electrode 14*a* may be heated quickly with less power.

Still another embodiment of the present invention will now be described with reference to FIG. 7. The same reference numerals in FIG. 7 denote the same parts in FIG. 1, and a detailed description thereof will be omitted. A thermionic cathode 11*b* is hemispherical in shape and is fixed to the distal end of a cylindrical partition wall 12*b*. A hemispherical auxiliary electrode 14*b* is fixed to the distal end of a support rod 15*b* such that its center is aligned with the center of the thermionic cathode 11*b* and a suitable gap is maintained between the inner circumferential surface of the thermionic cathode 11*b* and the outer circumferential surface of the auxiliary electrode 14*b*. A heating wire 17 is arranged in the vicinity of the auxiliary electrode 14*b*, and the auxiliary electrode 14*b* is heated by an electron beam from the heating wire 17.

In this embodiment, a cathode chamber 3 is defined by the inner circumferential surface of the thermionic cathode 11*b*, a partition wall 12*b*, and a side wall 5. Electric current flow occurs between the inner circumferential surface of the thermionic cathode 11*b* and the outer circumferential surface of the auxiliary electrode 14*b*, and the thermionic cathode 11*b* and the auxiliary cathode 14*b* are heated. As in the embodiment described with reference to FIG. 6, since the auxiliary electrode 14*b* is surrounded by the thermionic cathode 11*b*, heat radiated from the thermionic cathode 11*b* may be effectively utilized for heating the auxiliary electrode 14*b*. It is also possible to minimize the heat capacity of the auxiliary electrode 14*b*.

Figure 4:
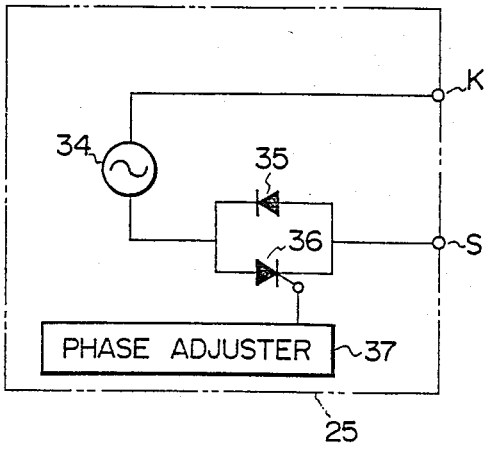
FIG. 4 is a circuit diagram of a modification of a power source unit of the apparatus shown in FIG. 1.
Figure 5:
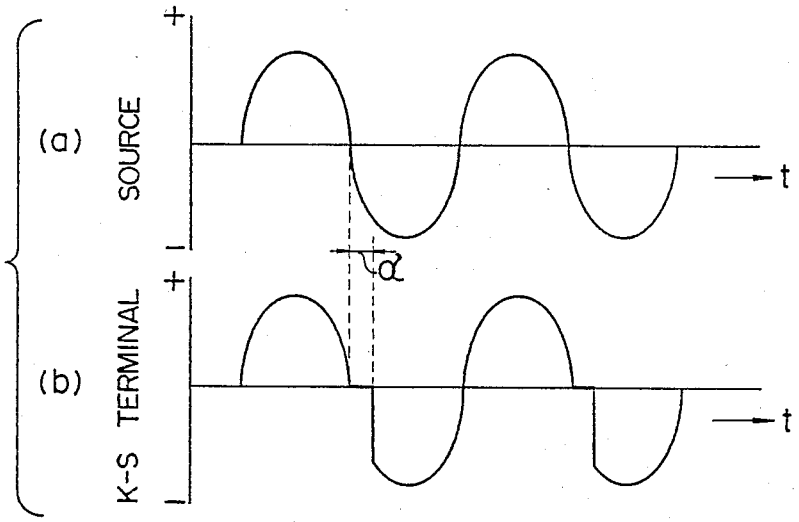
FIG. 5 shows the waveform of a signal supplied from the power source unit shown in FIG. 4.

A power source unit 25 is not limited to those shown in FIGS. 4 and 5. Any power source unit 25 may be adopted if it is capable of applying an A.C. voltage between the thermionic cathode and the auxiliary electrode such that effective power for keeping the thermionic cathode 11, 11*a* or 11*b* at a positive potential with respect to the auxiliary electrode is higher than that for keeping the auxiliary electrode 14, 14*a* or 14*b* at a positive potential with respect to the thermionic cathode.

Figure 6:
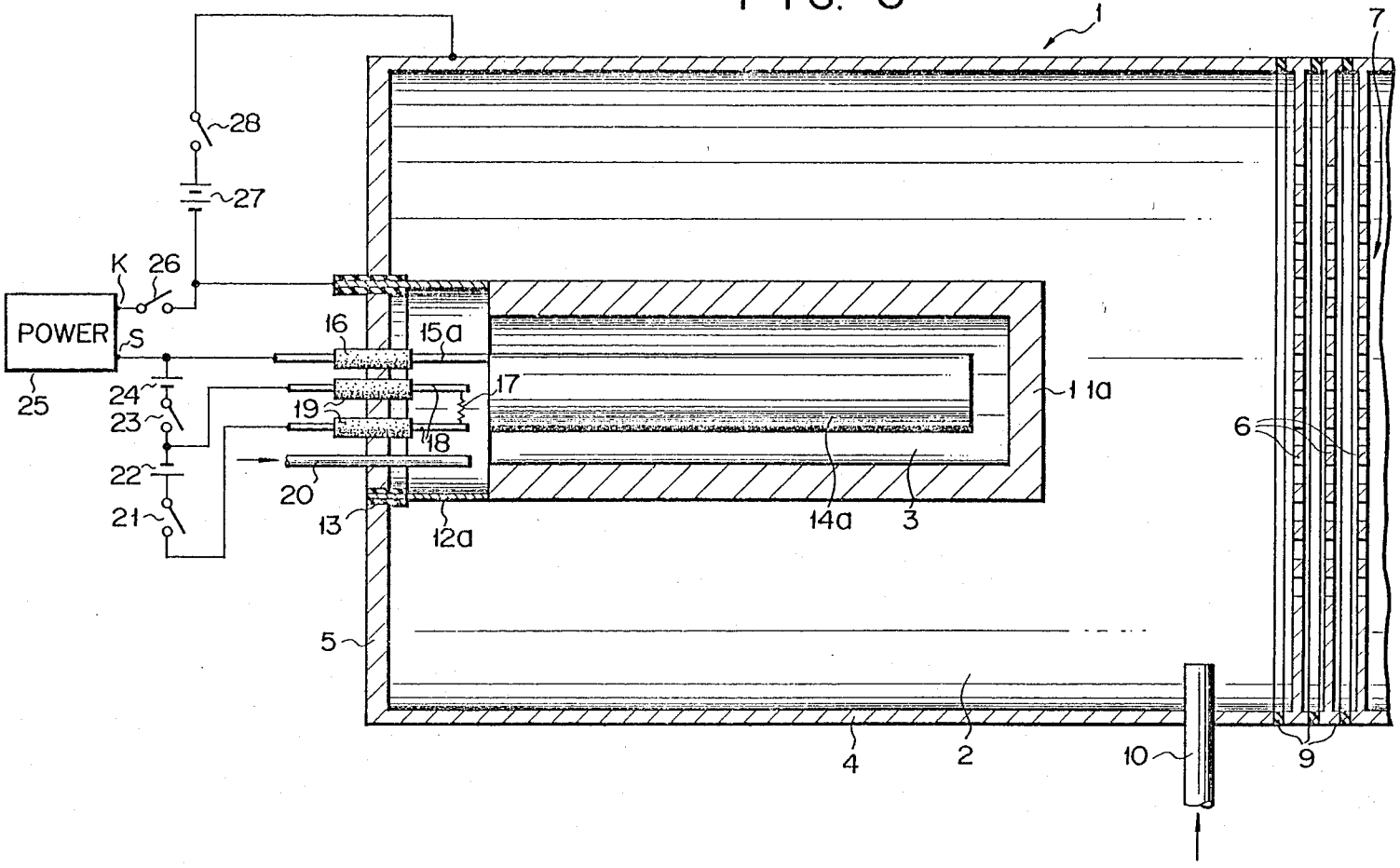
FIG. 6 is a sectional view showing an ion source apparatus according to another embodiment of the present invention.
Figure 7:
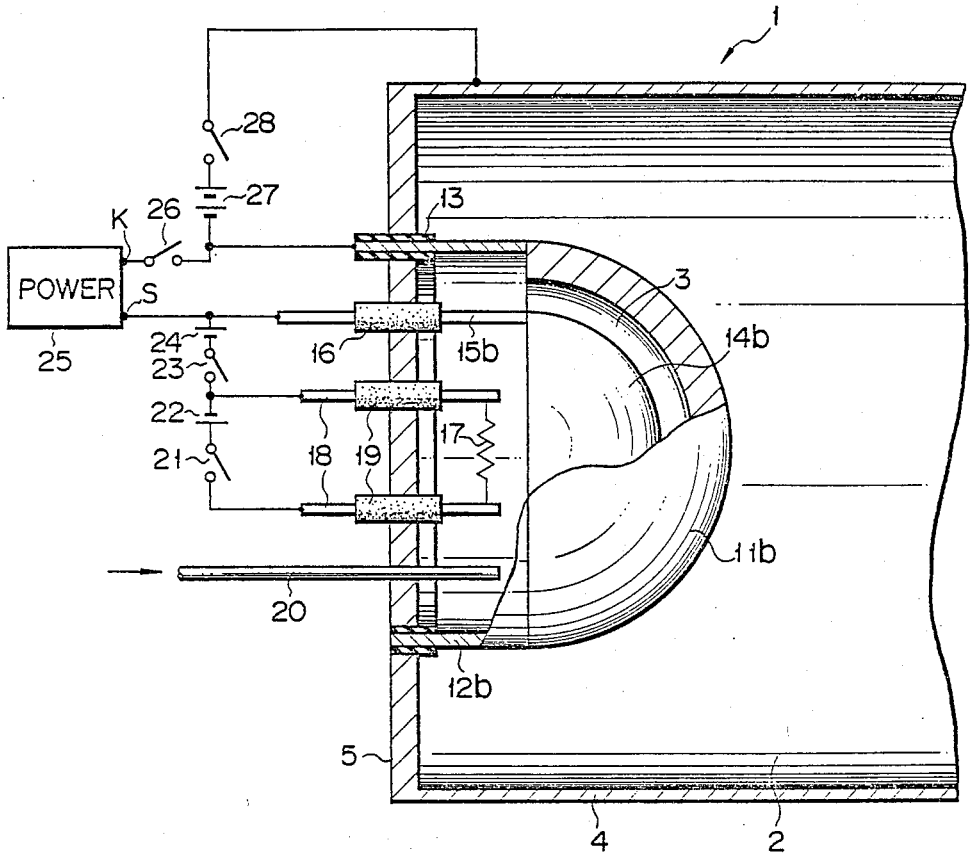
FIG. 7 is a sectional view of an ion source apparatus according to still another embodiment of the present invention.

In the embodiment wherein the thermionic cathode surrounds the auxiliary electrode, the shape of the thermionic cathode is not limited to those shown in FIGS. 6 and 7. The thermionic cathode and the auxiliary electrode need only be arranged relative to each other such that at least part of the inner surface of the thermionic cathode opposes at least part of the outer surface of the auxiliary electrode at a distance therefrom.

Furthermore, in the embodiments described above, in the initial heating period, thermoelectrons emitted from the heating wire 17 are accelerated by the power source 24 into an electron beam which heats the auxiliary electrode 14, 14*a* or 14*b*. However, heating process need not be initiated in this manner. For example, discharge may be initiated by irradiating the thermionic cathode or both the thermionic cathode and the auxiliary electrode with an electron beam. Furthermore, the heating need not be performed by an electron beam but may be performed by radiation heating from surface of ohmically heated body.

In the embodiments described above, one cathode chamber 3 is arranged in the discharge chamber 2. However, the number of cathode chambers is not limited to one. Thus, a plurality of cathode chambers may be defined in the discharge chamber by the thermionic cathode and the partition wall, in which the auxiliary electrodes are disposed. The arrangement of the discharge chamber and cathode chamber may be variously altered. A permanent magnet may be disposed at the anode wall to effectively confine the plasma.

The shapes and positional relationship of the discharge chamber 2, cathode chamber 3 and anode wall 4 are not limited to those in the embodiments described above. Similarly, the shapes of the insulators 9, 13, 16 and 19 are not limited to those in the embodiments described above. Furthermore, the thermionic cathode 11 and auxiliary electrode 14 may be supported in manners other than described above. Moreover, the number and shape of grid electrodes 6 are not limited to those in the embodiments described above.

What we claim is:

1. An ion source apparatus comprising:

a discharge chamber to which a gas is supplied;

a cathode chamber;

a thermionic cathode interposed between and partitioning the discharge chamber and the cathode chamber;

an auxiliary electrode which is arranged in the cathode chamber and which is adapted to produce emission current and/or electron current between the thermionic cathode and the auxiliary electrode;

a power source unit for supplying an A.C. voltage between the thermionic cathode and the auxiliary electrode such that effective power for keeping the thermionic cathode at a positive potential with respect to the auxiliary electrode is higher than that for keeping said auxiliary electrode at a positive potential with respect to the thermionic cathode; and an anode which causes a gas discharge between the anode and the thermionic cathode heated by discharge and/or electron bombardment between the thermionic cathode and the auxiliary electrode in the discharge chamber, thereby ionizing the gas.

2. An apparatus according to claim 1, wherein the thermionic cathode and the auxiliary electrode are flat and oppose each other with a distance therebetween.

3. An apparatus according to claim 2, further comprising a heater which is disposed in the vicinity of said auxiliary electrode and which is energized for heating, and a power source for supplying a voltage between the heater and the auxiliary electrode to maintain the auxiliary electrode at the positive potential, whereby thermoelectrons emitted from the heater are accelerated by the power source and are bombarded onto the auxiliary electrode to preheat the auxiliary electrode prior to discharge and/or electron bombardment between the auxiliary electrode and the thermionic cathode.

4. An apparatus according to claim 3, further comprising a housing having a cylindrical anode wall constituting the anode and a side wall mounted on one side of the anode wall, a grid electrode mounted on the other side of the anode wall, and a cylindrical partition wall, one end of which is mounted on the side wall and on the other end of which the thermionic cathode is mounted, whereby the discharge chamber is defined by the housing and the grid electrode, and the cathode chamber is defined by the thermionic cathode, the partition wall and the side wall.

5. An apparatus according to claim 2, wherein the power source unit supplies an AC voltage in which a DC positive voltage to be supplied to the thermionic cathode is superposed.

6. An apparatus according to claim 2, wherein said power source unit supplies an AC voltage having a waveform with a part of a first half cycle thereof being cut off, and a second half cycle thereof being suplied to the thermionic cathode, the first half cycle thereof being supplied to the auxiliary electrode.

7. An apparatus according to claim 1, wherein the thermionic cathode surrounds the auxiliary electrode at a predetermined distance.

8. An apparatus according to claim 7, wherein the thermionic cathode is a hollow cylinder having one closed end, said auxiliary electrode is a cylinder having a diameter smaller than an inner diameter of the thermionic cathode, and the auxiliary electrode is inserted into the thermionic cathode to be coaxial therewith.

9. An apparatus according to claim 7, wherein the thermionic cathode is a hemispherical shell, said auxiliary electrode is a hemisphere having a radius smaller than an inner radius of the thermionic cathode, and said auxiliary electrode is arranged within the thermionic cathode to be concentric therewith.

10. An apparatus according to claim 7, further comprising a heater which is disposed in the vicinity of said auxiliary electrode and which is energized for heating, and a power source for supplying a voltage between the heater and the auxiliary electrode to keep the auxiliary electrode at the positive potential, whereby thermoelectrons emitted from the heater are accelerated by the power source and bombarded onto the auxiliary electrode to preheat the auxiliary electrode prior to discharge and/or electron bombardment between the auxiliary electrode and the thermionic cathode.

11. An apparatus according to claim 10, further comprising a housing having a cylindrical anode wall constituting the anode and a side wall mounted on one side of the anode wall, a grid electrode mounted on the other side of the anode wall, and a cylindrical partition wall, one end of which is mounted on the side wall and on the other end of which the thermionic cathode is mounted, whereby the discharge chamber is defined by the housing and the grid electrode, and the cathode chamber is defined by the thermionic cathode, the partition wall, and the side wall.

12. An apparatus according to claim 7, wherein said power source unit supplies an AC voltage in which a DC positive voltage to be supplied to the thermionic cathode is superposed.

13. An apparatus according to claim 7, wherein said power source unit supplies an AC voltage having a waveform with a part of a first half cycle thereof being cut off, and a second half cycle thereof being supplied to the thermionic cathode, the first half cycle thereof being supplied to the auxiliary electrode.

* * * * *